US009861993B2

(12) United States Patent
Fu

(10) Patent No.: US 9,861,993 B2
(45) Date of Patent: Jan. 9, 2018

(54) STRUCTURE OF GYRATING NOZZLE HEAD SPRAY GUN

(71) Applicant: Neutek International Inc., New Taipei (TW)

(72) Inventor: Den-Nan Fu, New Taipei (TW)

(73) Assignee: Neutek International Inc., New Taipei (TW)

( * ) Notice: Subject to any disclaimer, the term of this patent is extended or adjusted under 35 U.S.C. 154(b) by 0 days.

(21) Appl. No.: 15/408,941

(22) Filed: Jan. 18, 2017

(65) Prior Publication Data

US 2017/0120266 A1 May 4, 2017

Related U.S. Application Data

(63) Continuation-in-part of application No. 14/709,146, filed on May 11, 2015, now Pat. No. 9,751,098.

(30) Foreign Application Priority Data

Jan. 20, 2016 (TW) ..... 105200826 U

(51) Int. Cl.
*B05B 3/16* (2006.01)
*B05B 7/24* (2006.01)
(Continued)

(52) U.S. Cl.
CPC ..... *B05B 3/16* (2013.01); *B05B 1/005* (2013.01); *B05B 3/04* (2013.01); *B05B 3/06* (2013.01);
(Continued)

(58) Field of Classification Search
CPC ..... B05B 3/16; B05B 7/2435; B05B 12/002; B05B 7/30; B05B 1/005; B05B 3/04;
(Continued)

(56) References Cited

U.S. PATENT DOCUMENTS 2,983,452 A * 5/1961 Lindbloom ..... A22B 5/08 239/210
3,868,949 A * 3/1975 Arneson ..... A61H 33/6036 4/541.6

(Continued)

*Primary Examiner* — Arthur O Hall
*Assistant Examiner* — Steven M Cernoch
(74) *Attorney, Agent, or Firm* — Muncy, Geissler, Olds & Lowe, P.C.

(57) ABSTRACT

A gyrating nozzle head spray gun includes grip including air inlet, valve seat, gas-delivery tube connected to valve seat and terminating in mating connection screw rod and trigger operable for letting external compressed air go into air inlet and gas-delivery tube, attachment tube connected to mating connection screw rod of the gas-delivery tube, gyrating nozzle head assembly including gas-supply tube connected to mating connection screw rod and suspended in attachment tube, bearing, cap, linking module and gyrating nozzle head mounted on one end of the gas-supply tube, and water-delivery tube having one end extended bottom of coupling hole of gas-delivery tube and connected to water tank for sucking in water and opposite end thereof inserted through gyrating nozzle head for ejecting fluid for creating mist of fine droplets upon ejection of compressed air through the gas-supply tube and oblique jet hole and central axle hole of the gyrating nozzle head.

9 Claims, 7 Drawing Sheets

(51) Int. Cl.

| | |
|---|---|
| ***B05B 12/00*** | (2006.01) |
| ***B05B 3/04*** | (2006.01) |
| ***B05B 3/06*** | (2006.01) |
| ***B05B 7/06*** | (2006.01) |
| ***B08B 3/02*** | (2006.01) |
| ***B08B 5/02*** | (2006.01) |
| ***B05B 1/00*** | (2006.01) |
| ***B05B 7/30*** | (2006.01) |

(52) U.S. Cl.
CPC ..... *B05B 7/064* (2013.01); *B05B 7/2435* (2013.01); *B05B 7/30* (2013.01); *B05B 12/002* (2013.01); *B08B 3/028* (2013.01); *B08B 5/02* (2013.01)

(58) Field of Classification Search
CPC ..... B05B 3/06; B05B 7/064; B08B 3/028; B08B 5/02
See application file for complete search history.

(56) References Cited

U.S. PATENT DOCUMENTS 4,523,340 A * 6/1985 Watkins ..... A61H 33/6063 261/DIG. 75
4,689,839 A * 9/1987 Henkin ..... A61H 33/027 239/416.4
4,704,826 A * 11/1987 Kirkland ..... B24C 3/325 188/296
4,716,604 A * 1/1988 Watkins ..... A61H 33/6063 138/110
4,821,961 A * 4/1989 Shook ..... B05B 3/06 239/253
5,060,862 A * 10/1991 Pacht ..... B05B 3/003 239/252
5,104,043 A * 4/1992 Pacht ..... B05B 3/006 239/128
5,232,161 A * 8/1993 Clemmons ..... B05B 1/1654 239/345
5,284,298 A * 2/1994 Haynes ..... B05B 3/06 239/254
5,909,848 A * 6/1999 Zink ..... B05B 3/003 188/184
6,193,169 B1 * 2/2001 Steinhilber ..... B05B 3/003 239/240
7,546,959 B2 * 6/2009 Wagner ..... B05B 3/003 239/251
8,056,830 B1 * 11/2011 Pedersen ..... B05B 3/028 239/222.13
8,480,011 B2 * 7/2013 Endo ..... B05B 3/022 239/226
8,690,077 B2 * 4/2014 Sendo ..... B05B 3/022 239/226
8,857,737 B2 * 10/2014 Chen ..... B05B 3/06 239/302
9,144,810 B2 * 9/2015 Bosua ..... B05B 15/025
9,211,560 B1 * 12/2015 Chen ..... B05B 3/06
9,321,067 B2 * 4/2016 Schaer, III ..... B05B 3/02
9,399,230 B2 * 7/2016 Wojciechowski, III .. B05B 3/06
9,475,071 B2 * 10/2016 Endo ..... B05B 3/022
2010/0320289 A1 * 12/2010 Kuo ..... B05B 3/022 239/290
2012/0286065 A1 * 11/2012 Lin ..... B05B 3/0409 239/225.1
2014/0008457 A1 * 1/2014 Bosua ..... B05B 15/025 239/104
2014/0061334 A1 * 3/2014 Liao ..... B05B 3/00 239/315
2015/0266041 A1 * 9/2015 Liao ..... B05B 3/06 239/373
2016/0001313 A1 * 1/2016 Chen ..... B05B 3/06 239/332
2016/0339458 A1 * 11/2016 Fu ..... B60S 3/044
2017/0072414 A1 * 3/2017 Fu ..... B60S 3/044

* cited by examiner

STRUCTURE OF GYRATING NOZZLE HEAD SPRAY GUN

This application is a Continuation-In-Part of co-pending application Ser. No. 14/709,146, filed on May 11, 2015 for which priority is claimed under 35 U.S.C. §120, the entire contents of which are hereby incorporated by reference.

This application claims the priority benefit of Application No. 105200826 filed in Taiwan on Jan. 20, 2016.

BACKGROUND OF THE INVENTION

1. Field of the Invention

The present invention relates to spray gun technology and more particularly, to an improved structure of gyrating nozzle head spray gun, which comprises a grip, an attachment tube connected to the grip, and a gyrating nozzle head assembly connected to the grip and surrounded by the attachment tube for ejecting compressed air in a spiral pattern.

2. Description of the Related Art

FIGS. 6 and 7 illustrate a gyrating nozzle head spray gun. The gyrating nozzle head spray gun generally comprises a grip A, a gas-delivery tube A1 connected to one end of the grip A, a water tank A11 detachably connected to a bottom side of the gas-delivery tube A1, a dip tube A12 dipped in water in the water tank A11, a water-supply tube A13 connected to the top end of the dip tube A12 and axially inserted through the gas-delivery hole A10 of the gas-delivery tube A1, and a gyrating nozzle head assembly B. The gyrating nozzle head assembly B comprises a gas-supply tube B1 connected to the gas-delivery tube A1 and defining therein a gas-supply hole B10, a gyrating nozzle head B2, and a bearing B3 supporting the gyrating nozzle head B2 on a connection portion B11 at the distal end of the gas-supply tube B1. The gyrating nozzle head B2 comprises a gas accumulation chamber B20, a through hole B21 located at the center of the front side thereof in communication with the gas accumulation chamber B20 and an oblique jet hole B22 in communication with the gas-supply hole B10. The water-supply tube A13 has a water outlet end A131 inserted through the gas accumulation chamber B20 of the gyrating nozzle head B2 and the through hole B21. Further, the diameter of the through hole B21 is larger than the outer diameter of the water outlet end A131 so that a clearance is defined between the through hole B21 and the water outlet end A131 of the water-supply tube A13. The air inlet A2 of the grip A is connected to an external air compressor using a gas tube A21. Thus, the user can operate the trigger A3 of the grip A to open the air inlet A2 of the valve seat A4 for letting compressed air flow through the gas-delivery hole A10 of the gas-delivery tube A1 into the gas-supply hole B10 of the gas-supply tube B1 of the gyrating nozzle head assembly B and the gas accumulation chamber B20 of the gyrating nozzle head B2 for ejecting out of the oblique jet hole B22 and forcing the gyrating nozzle head B2 to rotate on the bearing B3. When compressed air is guided into the gas-supply tube B1 and the through hole B21 of the gyrating nozzle head B2, water is sucked in the dip tube A12 from the water tank A11 and guided through the water-supply tube A13 toward the opposite water outlet end A131 and the through hole B21 of the gyrating nozzle head B2. At the same time, compressed air is ejected out of the gas accumulation chamber B20 through the clearance between the through hole B21 and the water outlet end A131 of the water-supply tube A13 and the oblique jet hole B22 of the gyrating nozzle head B2 to turn the ejected flow of water into a mist of fine droplets.

When the dip tube A12 delivers water from the water tank A11 into the water-supply tube A13 for ejection through the water outlet end A131 of the water-supply tube A13 and the through hole B21 of the gyrating nozzle head B2, compressed air is simultaneously ejected out of the gas accumulation chamber B20 and oblique jet hole B22 of the gyrating nozzle head B2, causing rotation of the gyrating nozzle head B2 on the bearing B3 at a high speed. During high speed rotation of the gyrating nozzle head B2, the water outlet end A131 is forced by the high pressure of the compressed air in the gas accumulation chamber B20 to vibrate in the through hole B21. Vibration of the water outlet end A131 causes the water outlet end A131 to rub against the through hole B21. Because the gyrating nozzle head B2 is a metal member and the water-supply tube A13 is a flexible plastic member, vibration of the water outlet end A131 of the water-supply tube A13 to wear against the peripheral wall of the through hole B21 can wear the water outlet end A131, affecting the performance of the gyrating nozzle head spray gun. Therefore, it is desirable to provide a gyrating nozzle head spray gun that eliminates the aforesaid problem.

SUMMARY OF THE INVENTION

The present invention has been accomplished under the circumstances in view. It is therefore the main object of the present invention to provide a gyrating nozzle head spray gun, which comprises a grip equipped with a gas-delivery tube and a trigger, an attachment tube connected to the gas-delivery tube, a water tank detachably mounted at the bottom side of the gas-delivery tube, a water-delivery tube inserted through the gas-delivery tube and dipped with one end thereof in the water tank, and a gyrating nozzle head assembly connected to the gas-delivery tube holding a gyrating nozzle head in an orifice of the attachment tube in a rotatable manner for ejecting the compressed air from the gas-supply tube and the fluid sucked in by the water-delivery tube. Thus, when operating the trigger of the grip for letting a flow of compressed air enter the gas-delivery tube toward the gyrating nozzle head, the intake flow of compressed air forces the gyrating nozzle head of the gyrating nozzle head assembly to rotate in the orifice of the attachment tube and also turns the ejected fluid into a mist of fine droplets.

Preferably, the gyrating nozzle head spray gun comprises a grip that comprises a trigger-controlled valve seat and a gas-delivery tube extended from the valve seat and terminating in a mating connection screw rod, an attachment tube connected to the mating connection screw rod of the gas-delivery tube, and a gyrating nozzle head assembly, which comprises a gas-supply tube connected to the mating connection screw rod of the gas-delivery tube and suspending in an accommodation chamber of the attachment tube, a linking module, a bearing, a cap and a gyrating nozzle head mounted on a connecting connection screw rod of the gas-supply tube. When operating the trigger of the grip, compressed air is guided through an air inlet of the grip into the gas-supply tube of the gyrating nozzle head assembly and then forced out of an oblique jet hole of the gyrating nozzle head, and at the same time, a centrifugal force is created and force the gyrating nozzle head to rotate in an orifice of the attachment tube, and thus, a swirling flow of compressed air is ejected out of the spray gun. Further, the gas-delivery tube can be configured to provide a bottom coupling hole for the connection of a water tank, and a water-delivery tube is mounted in the gas-delivery hole of the gas-delivery tube and extended from the bottom coupling hole through the gas-supply hole of the gas-supply tube of the gyrating nozzle head assembly into the gas accumulation chamber of the gyrating nozzle head and terminating in a water outlet tip that is inserted into a central axle hole in the gyrating nozzle head. Thus, when a swirling flow of compressed air is ejected out of the annular gap in the through hole around the water outlet tip, a flow of fluid is sucked into the bottom connection tube of the gas-delivery tube and the water-delivery tube and ejected out of the water outlet tip of the water-delivery tube, and the fluid being ejected out of the water outlet tip is then turned into a mist, compressed air is simultaneously ejected out of the oblique jet hole, making the mist finer.

Preferably, the gyrating nozzle head assembly comprises gas-supply tube that comprises a threaded neck located at one end thereof and threaded into a screw hole of the mating connection screw rod of the gas-delivery tube, a connecting portion located at an opposite end thereof and a gas-supply hole axially extending through the threaded neck and the connecting portion, a linking module consisting of a coupling socket, a stopper and an inner liner and mounted on the connecting portion of the gas-supply tube, a bearing mounted with an outer race thereof in the coupling socket, a cap fastened to the connecting portion of the gas-supply tube to stop the bearing in place and comprising a cone head and a through hole cut through the center of the cone head for the passing of the water outlet end of the water-delivery tube and a plurality of air guide holes equiangularly spaced around said cone head, and a gyrating nozzle head mounted on the coupling socket and comprising a gas accumulation chamber accommodating the coupling socket and the cap, said water outlet end of said water delivery tube inserted through a central axle hole, and an oblique jet hole disposed in communication with the gas accumulation chamber for ejecting compressed gas. Further, the connecting portion of the gas-supply tube comprises a coupling stub tube for the mounting of the coupling socket, a tubular screw rod axially forwardly extended from the coupling stub tube and fastened up with the cap, and an annular collar connected between the coupling stub tube and the tubular screw rod for supporting the bearing. Further, the coupling socket of the linking module comprises an outer thread extended around the periphery thereof. Further, the gyrating nozzle head comprises an inner thread located in the gas accumulation chamber and threaded onto the outer thread of the coupling socket of the linking module.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
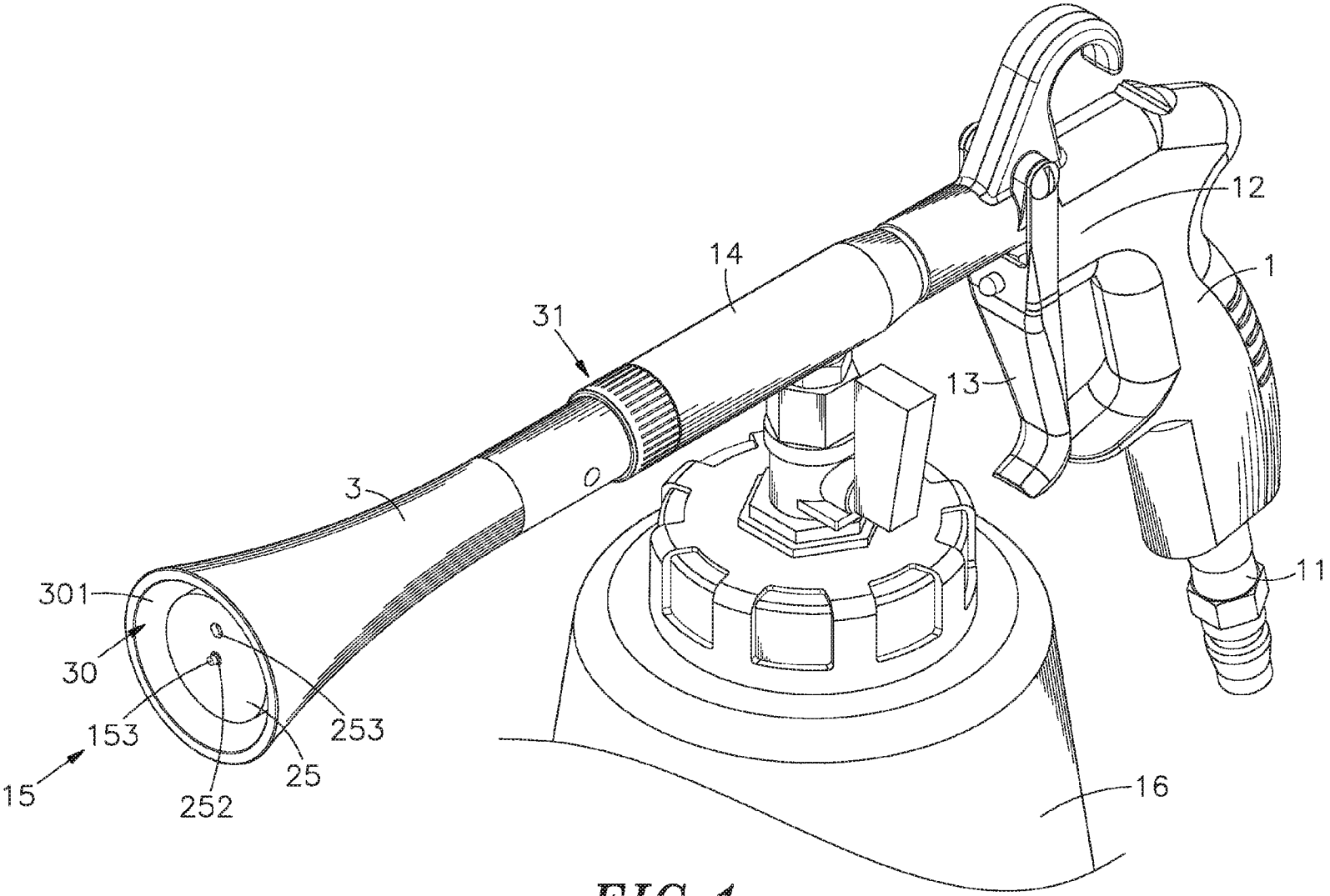
FIG. 1 is an oblique top elevational view of an improved structure of gyrating nozzle head spray gun in accordance with the present invention.
Figure 2:
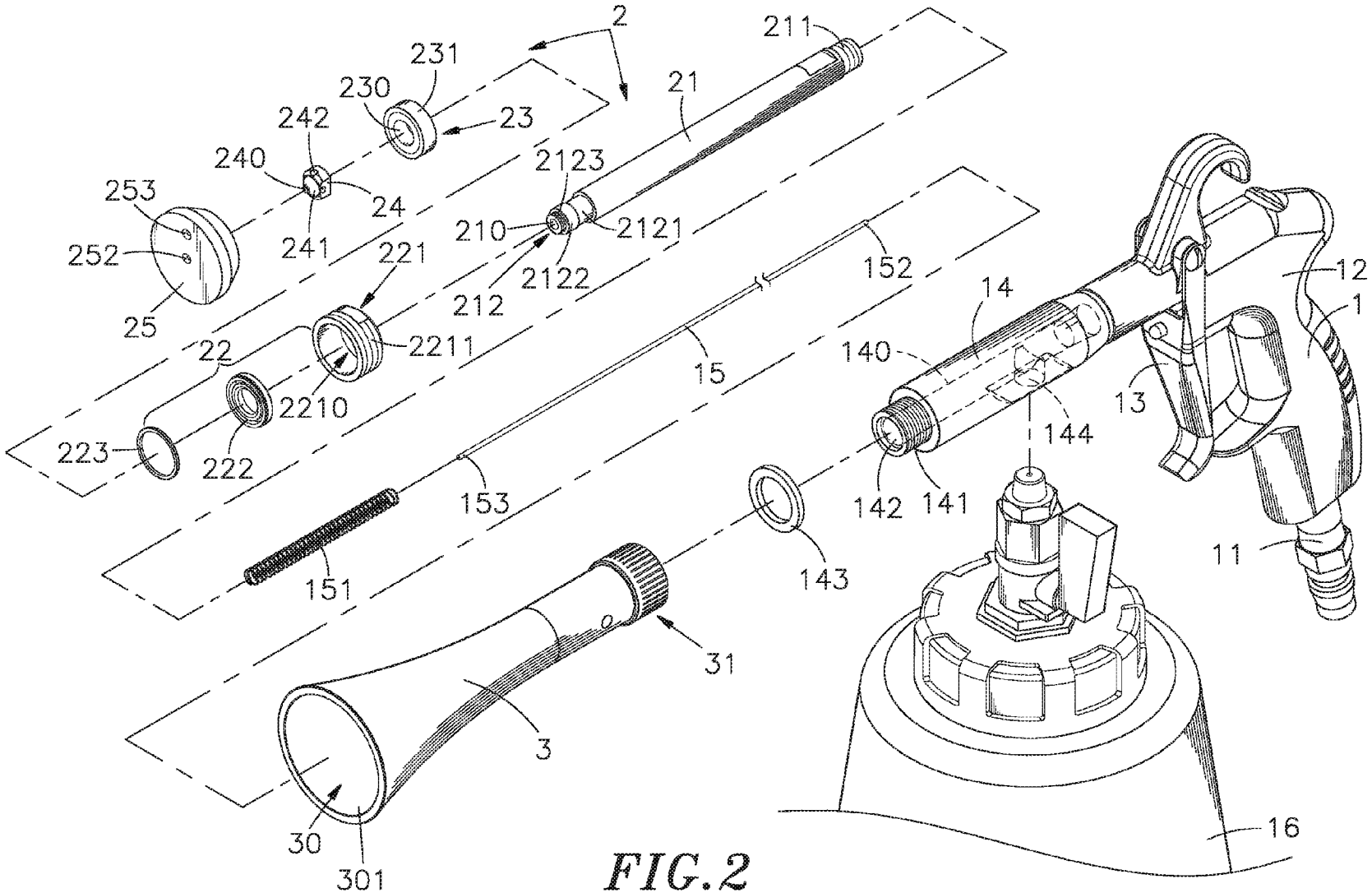
FIG. 2 is an exploded view of the improved structure of gyrating nozzle head spray gun in accordance with the present invention.
Figure 3:
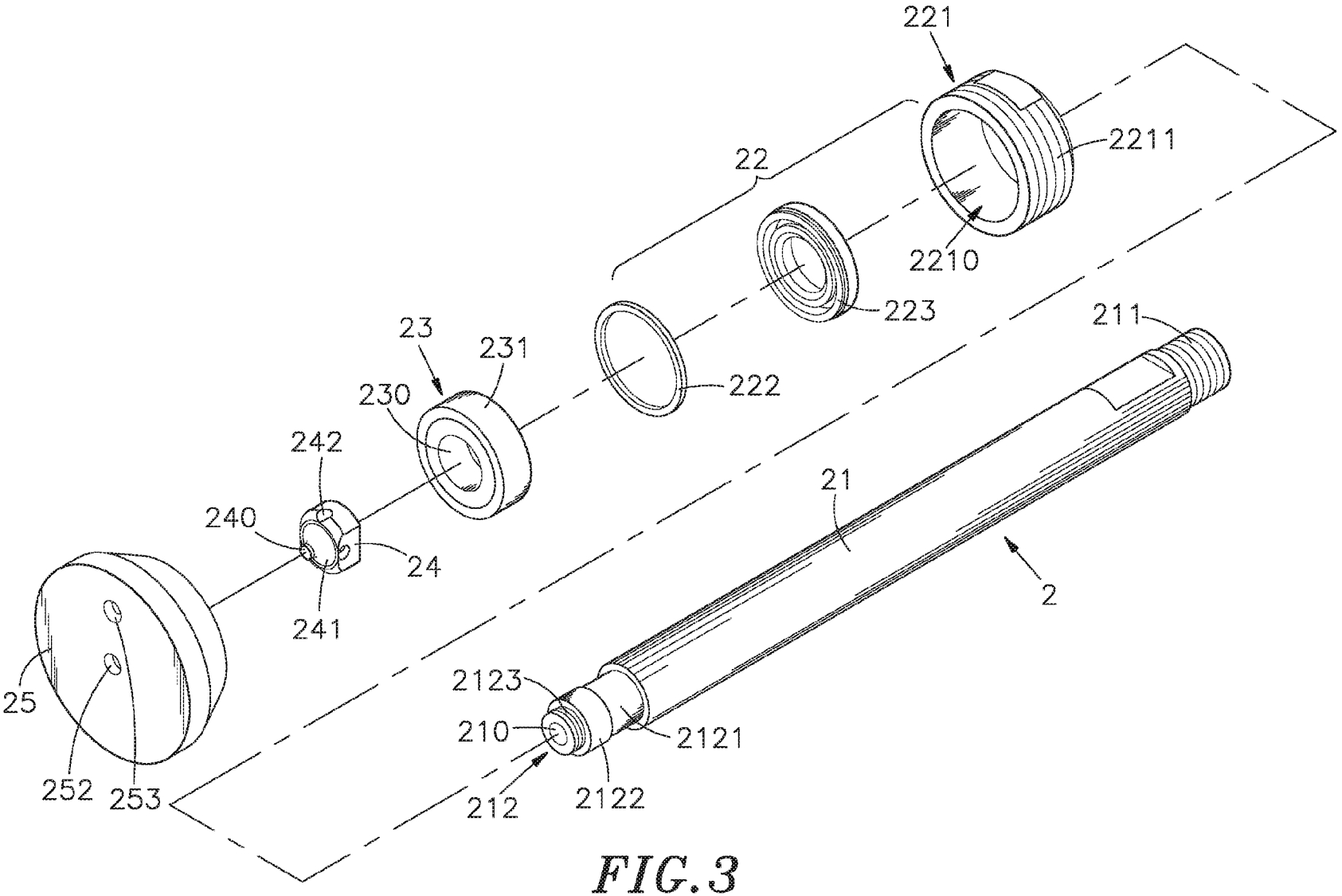
FIG. 3 is an exploded view of the improved structure of gyrating nozzle head assembly in accordance with the present invention.
Figure 4:
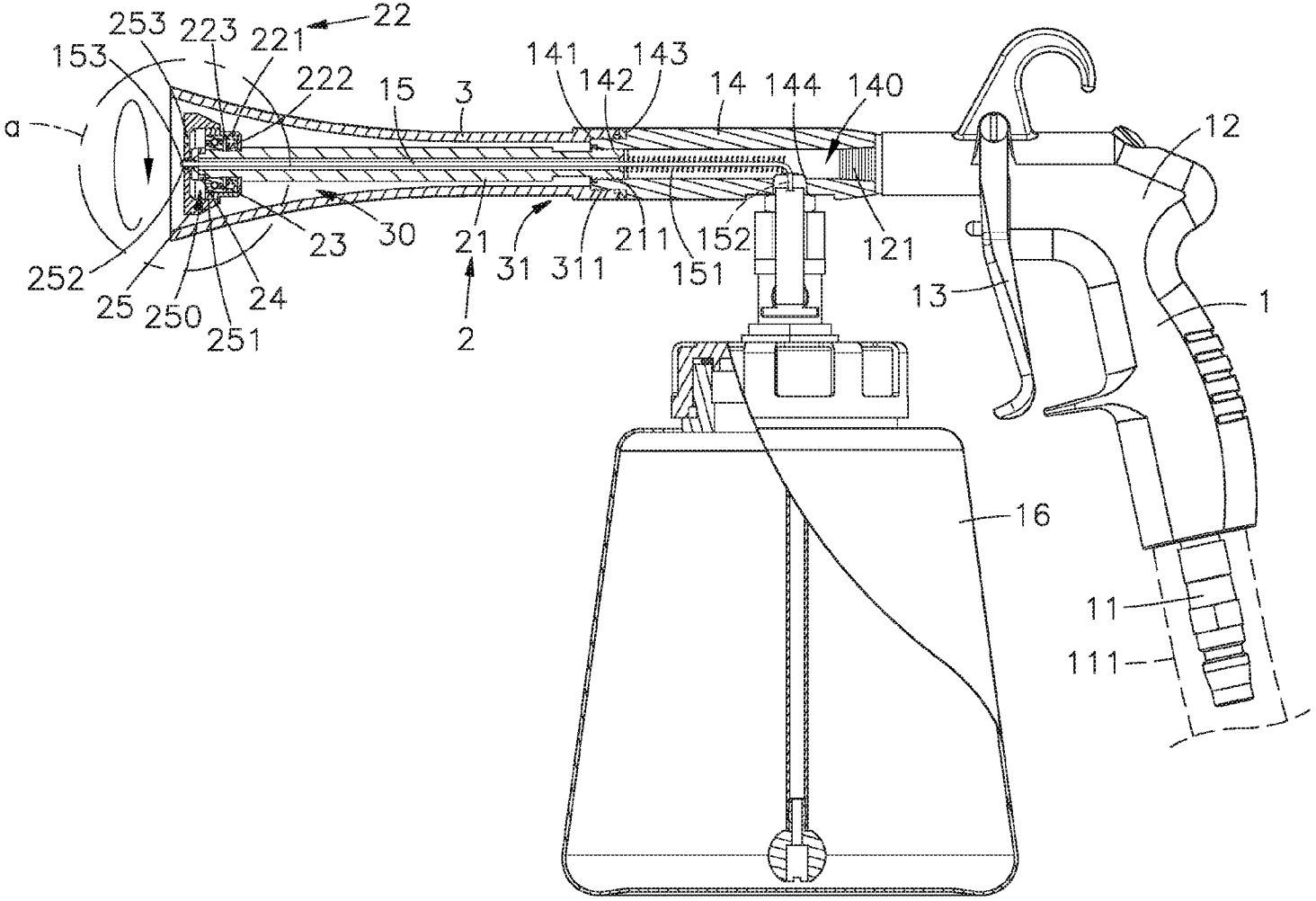
FIG. 4 is a schematic sectional side view of the improved structure of gyrating nozzle head spray gun in accordance with the present invention.
Figure 5:
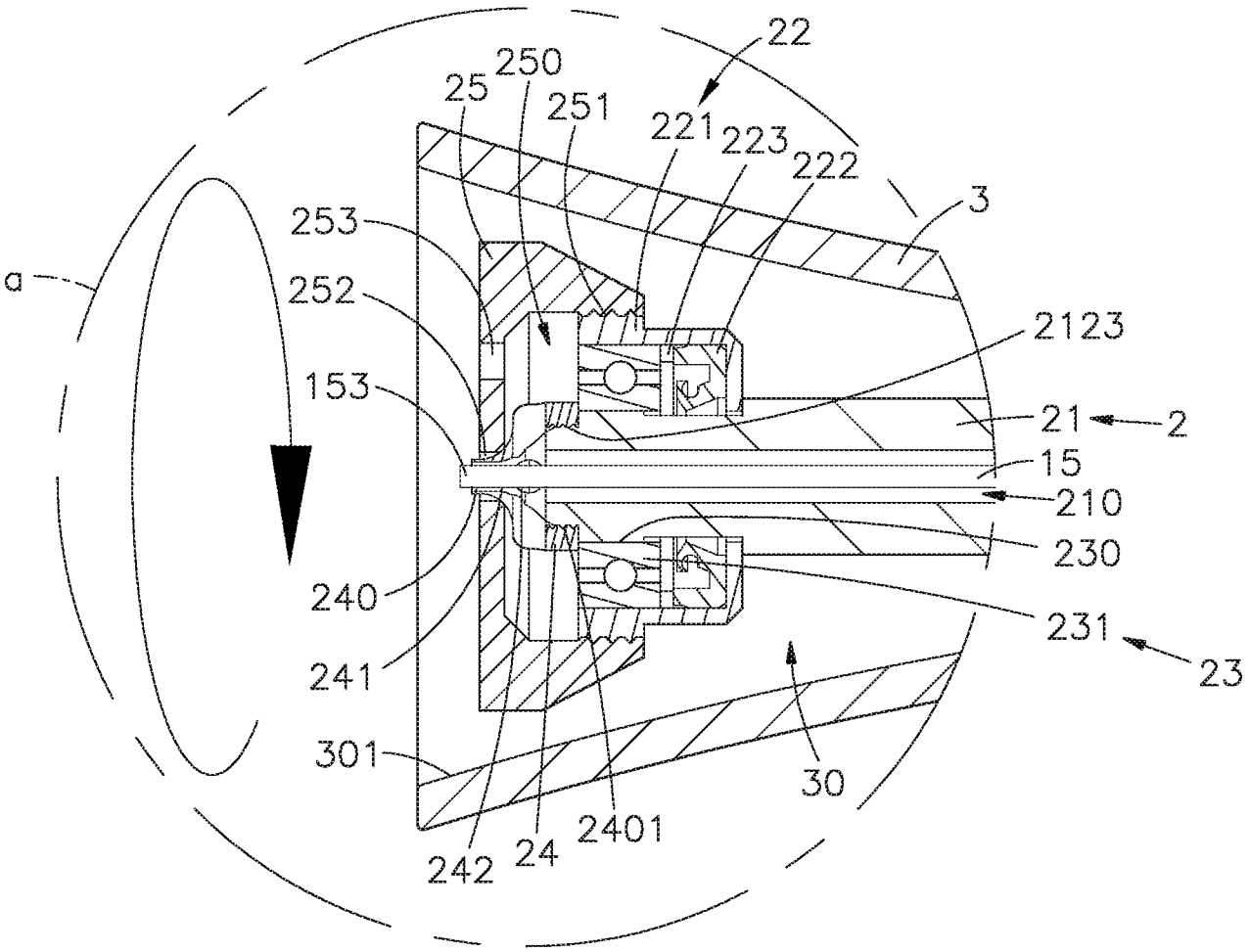
FIG. 5 is an enlarged view of Part a of FIG. 4.
Figure 6:
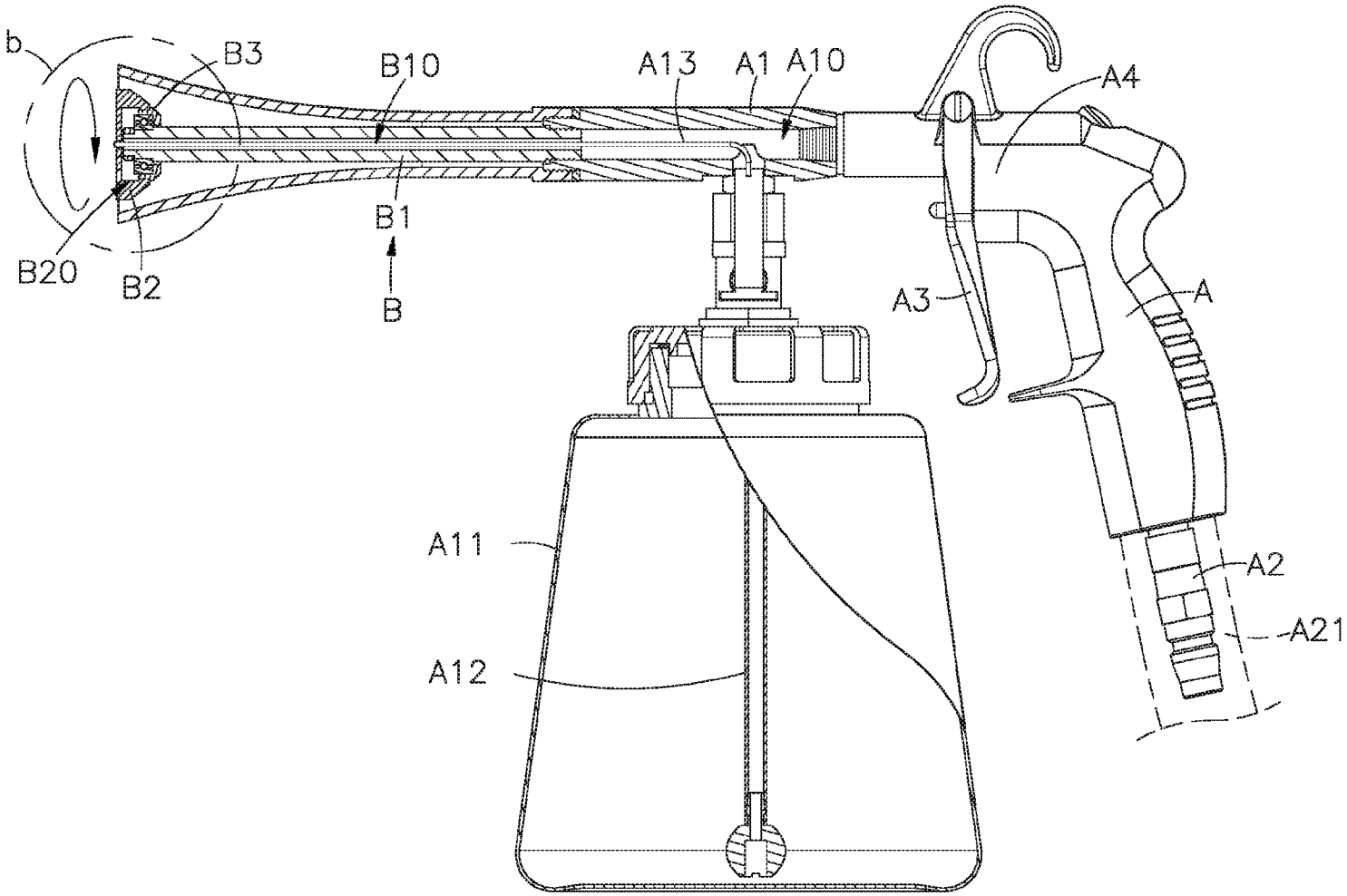
PRIOR ART FIG. 6
FIG. 6 is a schematic sectional side view of a gyrating nozzle head spray gun according to the prior art.
Figure 7:
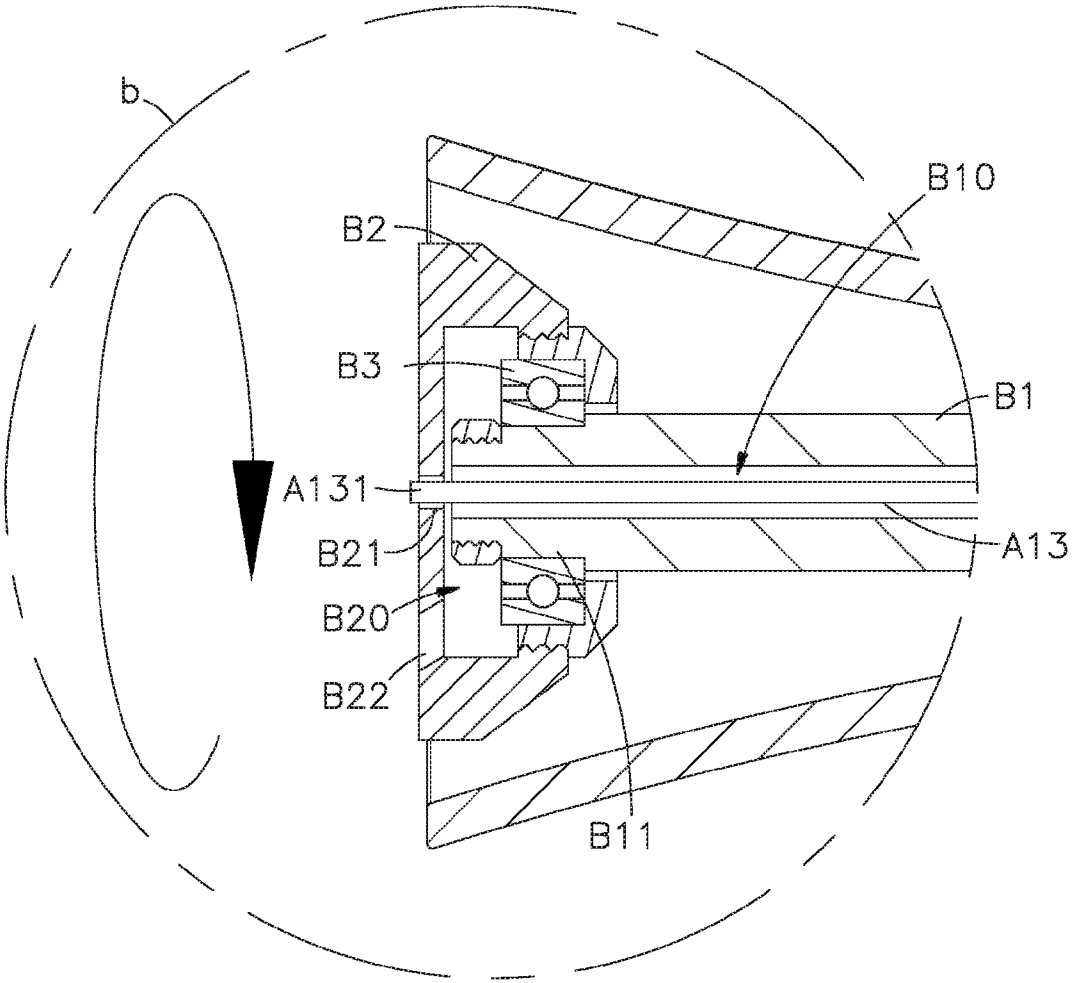
PRIOR ART FIG. 7
FIG. 7 is an enlarged view of Part b of FIG. 6.

Referring to FIGS. 1-5, a gyrating nozzle head spray gun in accordance with the present invention is shown. As illustrated, the gyrating nozzle head spray gun comprises a grip 1, a gyrating nozzle head assembly 2, and an attachment tube 3.

The grip 1 comprises an air inlet 11 located at a bottom side thereof, a valve seat 12 located at a top side thereof, a trigger 13 operable to open the valve seat 12 for letting an outer compressed flow of air flow through a hose 111 of the air inlet 11 into the valve seat 12 toward an air outlet 121 of the valve seat 12, a gas-delivery tube 14, which is connected with an inner end thereof to an outer end of the valve seat 12 opposite to the air inlet 11 and which comprises a gas-delivery hole 140 axially disposed in communication with the valve seat 12 and the air inlet 11, a mating connection screw rod 141 axially extended from an opposite outer end thereof opposite to the valve seat 12, a screw hole 142 defined in the mating connection screw rod 141 in communication with the gas-delivery hole 140, a coupling hole 144 transversely cut through the peripheral wall thereof, a water-delivery tube 15 having a water suction end 152 curved and extended out of the coupling hole 144 and an opposite water outlet end 153 extended out of the mating connection screw rod 141 of the gas-delivery tube 14, a spring 151 mounted around the water-delivery tube 15 with one end thereof stopped against one end of a gas-supply tube 21 of the gyrating nozzle head assembly 2 and a water tank 16 connected to the coupling hole 144 to receive the water suction end 152 outside the coupling hole 144 for enabling the water suction end 152 to suck water from the water tank 16 into the water-delivery tube 15.

The gyrating nozzle head assembly 2 comprises a gas-supply tube 21, a linking module 22, a bearing 23, a cap 24 and a gyrating nozzle head 25. The gas-supply tube 21 comprises a gas-supply hole 210 axially extending through opposing front and rear ends thereof, a threaded neck 211 axially backwardly extended from the rear end of the gas-supply tube 21, and a connecting portion 212 located at the front end. The connecting portion 212 comprises a coupling stub tube 2121 axially forwardly extended from the front end of the gas-supply tube 21, a tubular screw rod 2123 axially forwardly extended from the coupling stub tube 2121, and an annular collar 2122 connected between the coupling stub tube 2121 and the tubular screw rod 2123. The linking module 22 comprises a coupling socket 221 attached to the coupling stub tube 2121 of the connecting portion 212 and defining an accommodation chamber 2210 therein and an outer thread 2211 around the periphery thereof, a stopper 222 mounted in the accommodation chamber 2210, and an inner liner 223 mounted in the accommodation chamber 2210 and attached to the stopper 222. The bearing 23 defines therein an axle hole 230 that is coupled to the annular collar 2122 of the connecting portion 212 of the gas-supply tube 21. Further, the outer race 231 of the bearing 23 is engaged into the accommodation chamber 2210 of the coupling socket 221 of the linking module 22. The cap 24 comprises a cone head 241 located at one side thereof, a through hole 240 cut through the center of the cone head 241, a screw hole 2401 located at an opposite side thereof in communication with the through hole 240 and threaded onto the tubular screw rod 2123 to stop the bearing 23 from falling out of the annular collar 2122 of the connecting portion 212, and a plurality of air guide holes 242 equiangularly spaced around the cap 24 and disposed in communication with the through hole 240. The gyrating nozzle head 25 comprises an inner thread 251 located in one side thereof and threaded onto the outer thread 2211 of the coupling socket 221 of the linking module 22, a gas accumulation chamber 250 defined therein and inwardly extended from the outer thread 2211, a central axle hole 252 cut through the center of an opposite side thereof and disposed in communication with the gas accumulation chamber 250 and an oblique jet hole 253 obliquely cut through the opposite side and at an off-center location disposed in communication with the gas accumulation chamber 250.

The attachment tube 3 comprises a mating connection end piece 31 located at one end thereof, a mating connection screw hole 311 defined in the mating connection end piece 31, an expanded orifice 301 located at an opposite end thereof, and an accommodation chamber 30 defined therein and axially disposed in communication between the mating connection screw hole 311 and the orifice 301.

In installation, connect the air inlet 11 of the grip 1 to an external high-pressure air source through the hose 111. At this time, the user can operate the trigger 13 of the grip 1 to control the intake of compressed air from the external high-pressure air source through the air inlet 11. Thereafter, mount the linking module 22, the bearing 23, the cap 24 and the gyrating nozzle head 25 on the connecting portion 212 of the gas-supply tube 21. Insert one end of the water-delivery tube 15 through the gas-delivery hole 140 and the coupling hole 144, and then mount a gasket ring 143 on the mating connection screw rod 141 of the gas-delivery tube 14 of the grip 1. Insert the gyrating nozzle head assembly 2 through the orifice 301 of the attachment tube 3. Thereafter, thread the screw hole 142 of the gas-delivery tube 14 of the grip 1 onto the threaded neck 211 of the gas-supply tube 21 of the gyrating nozzle head assembly 2, enabling the opposite water outlet end 153 of the water-delivery tube 15 to extend out of the gas-supply tube 21 and the through hole 240 and cone head 241 of the cap 24 and thread the mating connection end piece 31 of the attachment tube 3 onto the mating connection screw rod 141 to hold down the gasket ring 143. At this time, the connecting portion 212 of the gas-supply tube is suspending in the accommodation chamber 30 of the attachment tube 3, and the gyrating nozzle head 25 is suspending in the expanded orifice 301. Thus, the grip 1, the gyrating nozzle head assembly 2 and the attachment tube 3 are assembled to constitute the gyrating nozzle head spray gun of the present invention.

Further, the attachment tube 3 that is connected to the gas-delivery tube 14 of the grip 1 can be a horn tube, straight tube or polygonal tube.

Further, the gas-delivery tube 14 can be a T-shaped three-way tube with the coupling hole 144 thereof coupled with the water tank 16. Further, the water suction end 152 of the water-delivery tube 15 is curved downwards and extended through the coupling hole 144 into the inside of the water tank 16; the opposing water outlet end 153 of the water-delivery tube 15 is inserted through the gas-delivery hole 140 of the gas-delivery tube 14 into the gas-supply hole 210 of the gas-supply tube 21 of the gyrating nozzle head assembly 2 and the through hole 240 of the cap 24 to the outside of the cone head 241 of the cap 24 and then inserted through the central axle hole 252 of the gyrating nozzle head 25. Further, the diameter of the central axle hole 252 is greater than the outer diameter of the cone head 241 and the outer diameter of the water outlet end 153 of the water-delivery tube 15 so that a gap is defined between the central axle hole 252 and the cone head 241, and the water outlet end 153 of the water-delivery tube 15 is protected by the cone head 241 of the cap 24 and prohibited from contacting the central axle hole 252. Thus, the water outlet end 153 will not be worn by the central axle hole 252 of the gyrating nozzle head 25 during rotation of the gyrating nozzle head 25, avoiding damage. Further, as stated above, the water outlet end 153 of the water-delivery tube 15 is inserted through the gas-delivery hole 140 of the gas-delivery tube 14, the spring 151 is mounted around the water-delivery tube 15 with its one end stopped against one end of the gas-supply tube 21, preventing oscillation of the water-delivery tube 15 to hit against the peripheral wall of the gas-delivery hole 140 of the gas-delivery tube 14 of the grip 1 and the peripheral wall of the gas-supply hole 210 of the gas-supply tube 21 at the threaded neck 211 end during the delivery of an intake flow of compressed air from the external high-pressure air source into the gas-delivery hole 140 and the gas-supply hole 210.

Further, the gyrating nozzle head assembly 2 is connected to the mating connection screw rod 141 of the gas-delivery tube 14 of the grip 1 by threading the threaded neck 211 of the gas-supply tube 21 of the gyrating nozzle head assembly 2 into the screw hole 142 in the mating connection screw rod 141 of the gas-delivery tube 14; the coupling socket 221 of the linking module 22 is mounted on the coupling stub tube 2121 of the connecting portion 212 of the gas-supply tube 21; the bearing 23 is mounted on the annular collar 2122 of the connecting portion 212; the cap 24 is threaded onto the tubular screw rod 2123 of the connecting portion 212. Further, the outer diameter of the cap 24 is greater than the inner diameter of the axle hole 230 of the bearing 23 so that the cap 24 is stopped against the bearing 23 to prohibit the bearing 23 from falling out of the annular collar 2122. Further, the outer race 231 of the bearing 23 is press-fitted into the accommodation chamber 2210 of the coupling socket 221; the inner thread 251 of the gyrating nozzle head 25 is threaded onto the outer thread 2211 of the coupling socket 221; the gas-supply tube 21 of the gyrating nozzle head assembly 2 is suspending in the accommodation chamber 30 of the attachment tube 3, allowing rotation of the gyrating nozzle head 25 on the axis of the gas-supply tube 21 within the expanded orifice 301 of the attachment tube 3. When a flow of compressed air flows into the gas-supply hole 210 of the gas-supply tube 21, the flow of compressed air is then guided by the air guide holes 242 of the cap 24 into the gas accumulation chamber 250 of the gyrating nozzle head 25 toward the outside of the gyrating nozzle head 25 through the oblique jet hole 253, causing rotation of the gyrating nozzle head 25 with the coupling socket 221 and the outer race 231 of the bearing 23, and thus, the flow of compressed air is ejected out of the oblique jet hole 253 and widely diffused subject to the guidance of the expanded orifice 301 of the attachment tube 3. Because the gas-supply tube 21 is not rotated with the gyrating nozzle head 25 in the accommodation chamber 30 of the attachment tube 3, no centrifugal force will be acted on the gas-supply tube 21 to force the gas-supply tube 21 away from the attachment tube 3, and thus, the overall structural strength of the combination of the attachment tube 3 and the gyrating nozzle head assembly 2 is enhanced. Further, the cone head 241 of the cap 24 is inserted into the central axle hole 252 of the gyrating nozzle head 25 of the gyrating nozzle head assembly 2; the opposite water outlet end 153 of the water-delivery tube 15 is inserted through the through hole 240 of the cap 24 to the outside of the cone head 241; the water suction end 152 of the water-delivery tube 15 is dipped in the liquid inside the water tank 16. Thus, the water outlet end 153 of the water-delivery tube 15 can spray a liquid through the central axle hole 252 of the gyrating nozzle head 25 toward the outside. At the same time, a strong jet of compressed air is ejected out of the oblique jet hole 253 to turn the ejected flow of liquid into a mist further. Because the opposite water outlet end 153 of the water-delivery tube 15 is inserted through the through hole 240 of the cap 24 out of the cone head 241 and then into the central axle hole 252 of the gyrating nozzle head 25 without touching the peripheral wall of the central axle hole 252 of the gyrating nozzle head 25, avoiding wear and prolonging the lifespan. Further, the tubular screw rod 2123 of the connecting portion 212 of the gas-supply tube 21 of the gyrating nozzle head assembly 2 is screwed up with the screw hole 2401 of the cap 24 so that the cap 24 stops the bearing 23 and the coupling socket 221 firmly in place, prohibiting the bearing 23 and the coupling socket 221 from falling out of the connecting portion 212. Further, the inner thread 251 of the gyrating nozzle head 25 is threaded onto the outer thread 2211 of the coupling socket 221. Due to that the threading direction between the gyrating nozzle head 25 and the coupling socket 221 is turned to the rotating direction of the gyrating nozzle head 25, the centrifugal force thus produced during rotation of the gyrating nozzle head 25 with the coupling socket 221 on the bearing 23 does not cause separation between the gyrating nozzle head 25 and the coupling socket 221. Thus, in actual application, the combination of the gyrating nozzle head 25, the bearing 23 and the coupling socket 221 will not be forced out of the accommodation chamber 30 of the attachment tube 3, effectively reducing gyrating nozzle head spray gun application risk and ensuring a high level of application safety.

In conclusion, the invention provides gyrating nozzle head spray gun, which comprises a grip that comprises a trigger-controlled valve seat and a gas-delivery tube extended from the valve seat and terminating in a mating screw rod, an attachment tube connected to the gas-delivery tube and defining therein an accommodation chamber, and a gyrating nozzle head assembly consisting of a gas-supply tube, a linking module, a bearing, a cap and a gyrating nozzle head. The gas-supply tube has one end thereof connected to the gas-delivery tube, and an opposite end thereof terminating in a connecting portion and suspending in the accommodation chamber of the attachment tube. The linking module, the bearing, the cap and the gyrating nozzle head are mounted on the connecting portion of the gas-supply tube. When operating the trigger of the grip, compressed air is guided through an air inlet of the grip into the gas-supply tube of the gyrating nozzle head assembly and then forced out of an oblique jet hole of the gyrating nozzle head, and at the same time, a centrifugal force is created and force the gyrating nozzle head to rotate in an orifice of the attachment tube, and thus, a swirling flow of compressed air is ejected out of the spray gun. Further, a water-delivery tube is mounted in the gas-delivery tube with one end thereof curved downwards and extended out of a coupling hole of the gas-delivery tube and connected to a water tank and opposite end thereof terminating in a water outlet end that is inserted through the gas-supply tube of the gyrating nozzle head assembly and a through hole in a cone head of the cap into a central axle hole of the gyrating nozzle head for sending out a fluid that is immediately turned into a mist of fine droplets by the ejected compressed air. The design of the cone head of the cap effectively protects the water outlet end of the water-delivery tube, avoiding wear during rotation of the gyrating nozzle head.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An improved structure of gyrating nozzle head spray gun, comprising:

a grip comprising an air inlet connectable to an external high-pressure air source for the intake of a compressed air, a valve seat, a gas-delivery tube connected with an inner end thereof to a front side of said valve seat, a trigger operable to open said valve seat for letting said compressed air flow into said gas-delivery tube, said gas-delivery tube comprising a gas-delivery hole in communication with said valve seat and said air inlet, a coupling hole located at a bottom side thereof and a mating connection screw rod axially extended from an opposite outer end thereof opposite to said valve seat, said mating connection screw rod defining therein a screw hole;

a water-delivery tube having a water suction end curved and extended out of said coupling hole and an opposite water outlet end extended out of said screw hole of said mating connection screw rod of said gas-delivery tube;

an attachment tube connected to said mating connection screw rod; and a gyrating nozzle head assembly, said gyrating nozzle head assembly comprising a gas-supply tube, said gas-supply tube comprising a threaded neck located at one end thereof and threaded into said screw hole of said mating connection screw rod, a connecting portion located at an opposite end thereof and a gas-supply hole axially extending through said threaded neck and said connecting portion, a linking module consisting of a coupling socket, a stopper and an inner liner and mounted on said connecting portion of said gas-supply tube, a bearing mounted with an outer race thereof in said coupling socket, a cap fastened to said connecting portion of said gas-supply tube to stop said bearing in place, said cap comprising a cone head and a through hole cut through the center of said cone head for the passing of said water outlet end of said water-delivery tube and a plurality of air guide holes equiangularly spaced around said cone head, and a gyrating nozzle head mounted on said coupling socket, said gyrating nozzle head comprising a gas accumulation chamber accommodating said coupling socket and said cap, said water outlet end of said water-delivery tube inserted through a central axle hole, and an oblique jet hole disposed in communication with said gas accumulation chamber for ejecting compressed gas.

2. The gyrating nozzle head spray gun as claimed in claim 1, wherein said attachment tube comprises a mating connection screw hole located at one end thereof and threaded onto said mating connection screw rod of said gas-delivery tube of said grip, an attachment tube, a gasket ring mounted around said mating connection screw rod and stopped between said gas-delivery tube and said attachment tube, and an expanded orifice located at an opposite end, said attachment tube being selectively configured in the form of a horn tube, straight tube or polygonal tube.

3. The gyrating nozzle head spray gun as claimed in claim 1, further comprising a water tank detachably fastened to said coupling hole of said gas-delivery tube and adapted for holding a fluid, and a spring mounted around said water-delivery tube; one end of said water-delivery tube comprising said water suction end extended into said water tank and an opposite end of said water-delivery tube comprising said water outlet end inserted through said gas-supply tube, said through hole of said cap and said central axle hole of said gyrating nozzle head.

4. The gyrating nozzle head spray gun as claimed in claim 1, wherein said water-delivery tube is mounted with a spring around the periphery thereof, said spring having one end thereof stopped against said gas-supply tube.

5. The gyrating nozzle head spray gun as claimed in claim 1, wherein said connecting portion of said gas-supply tube comprises a coupling stub tube for the mounting of said coupling socket, a tubular screw rod axially forwardly extended from said coupling stub tube and fastened up with said cap, and an annular collar connected between said coupling stub tube and said tubular screw rod for supporting said bearing.

6. The gyrating nozzle head spray gun as claimed in claim 5, wherein the outer diameter of said collar is smaller than the outer diameter of said gas-supply tube; the outer diameter of said coupling stub tube and the outer diameter of said tubular screw rod are smaller than the outer diameter of said collar.

7. The gyrating nozzle head spray gun as claimed in claim 5, wherein the outer diameter of said cap is greater than the inner diameter of the said axle hole of said bearing.

8. The gyrating nozzle head spray gun as claimed in claim 5, wherein said coupling socket of said linking module comprises an outer thread extended around the periphery thereof; said gyrating nozzle head comprises an inner thread located in one end of said gas accumulation chamber and threaded onto said outer thread of said coupling socket of said linking module; a central axle hole cut through the center of an opposite side thereof and disposed in communication with said gas accumulation chamber and an oblique jet hole obliquely cut through the opposite side and disposed in communication with said gas accumulation chamber.

9. The gyrating nozzle head spray gun as claimed in claim 1, wherein said coupling socket comprises an accommodation chamber accommodating said stopper and said inner liner and engaged with said outer race of said bearing, and an outer thread extended around the periphery thereof; said gyrating nozzle head comprises an inner thread engaged with the said outer thread of said coupling socket.

* * * * *